United States Patent [19]

Ito

[11] 4,232,445

[45] Nov. 11, 1980

[54] KNIFE APPARATUS

[75] Inventor: Daizaburo Ito, Seki, Japan

[73] Assignee: Kai Cutlery Center Co., Ltd., Seki, Japan

[21] Appl. No.: 25,749

[22] Filed: Mar. 30, 1979

[30] Foreign Application Priority Data

Mar. 31, 1978 [JP] Japan ..... 53-41890[U]

[51] Int. Cl.[3] ..... B26B 1/08

[52] U.S. Cl. ..... 30/162

[58] Field of Search ..... 30/162, 320

[56] References Cited

U.S. PATENT DOCUMENTS

| | | | |
|---|---|---|---|
| 3,765,089 | 10/1973 | Ibata | 30/162 |
| 4,012,836 | 3/1977 | Baer | 30/320 |
| 4,103,421 | 8/1978 | Quenot | 30/162 |
| 4,170,062 | 10/1979 | Machida | 30/162 |

*Primary Examiner*—Jimmy C. Peters

*Attorney, Agent, or Firm*—Norbert P. Holler

[57] ABSTRACT

A knife apparatus having a knife handle of a substantially C-shaped cross-section defining a groove extending in a longitudinal direction of the handle, a slider slidably received by the groove of the handle and an elongated cutting blade secured to the slider so as to be extended and retracted as the slider is slided along the length of the groove. The knife handle is provided with a series of notches formed in one of the side walls thereof. The slider has a depressable resilient tab extending therefrom in the opposite direction to the cutting blade. The depressable resilient tab is provided with a pawl adapted to be received by selected one of the notches, when the depressable resilient tab is not depressed, so as to fix the slider against the sliding movement. As the depressable resilient tab is depressed, the pawl is disengaged from the notch to allow the slider to be freely slided. The body of the slider and the depressable resilient tab are unitarily formed of a plastic. The slider is provided with a resilient clicking tab which is adapted to be swung in the direction transverse to the direction of depression of the depressable resilient tab. The resilient clicking tab is interposed between the pawl and the notch when the depressable resilient tab is not depressed, and is adapted to impart to the user a feel of click during sliding of the slider.

5 Claims, 4 Drawing Figures

KNIFE APPARATUS

BACKGROUND OF THE INVENTION

The present invention relates to a knife apparatus including a knife handle or grip having a C-shaped cross-section defining a groove or a channel extending longitudinally thereof and a slider having a blade secured thereto and slidably received by the channel so that the blade can be withdrawn or projected bit by bit outwardly as the knife edge thereof wears out.

In the knife apparatus of the type described above, it has been hitherto known that a series or notches are formed in the knife handle or grip on the one hand, while a V-shaped spring member is mounted on the blade holder on the other hand, whereby the slider and hence the blade are securely held by the knife handle through the mutual engagement of the V-shaped spring and the notch. When the slider is moved to project the blade outwardly, the V-shaped spring is yieldably deformed to disengage from the notch. Such conventional structure is, however, disadvantageous in that the blade cannot be securely held by the knife handle or grip at the indexed position since the locked or latched state of the slider is assured only by the resiliency of the V-shaped spring member. Consequently, there may arise a danger of the blade tottering or rattling particularly in the applications where a relatively great cutting force is required. Of course, more positive locking of the slider as well as the blade to the knife handle may be attained by using a spring member having a correspondingly increased spring force. However, by doing so, the force required for smoothly sliding the slider is increased inconveniently.

To avoid this problem, there have been proposed various knife apparatus having means for releasably but forcibly keeping the V-shaped spring in engagement with the notch. These means are, however, constituted by a large number of parts of different materials and hence difficult to produce and assemble, incurring inconveniently a rise of production cost of the knife apparatus.

SUMMARY OF THE INVENTION

It is therefore a major object of the invention to provide an improved knife apparatus in which the slider to which a cutting blade is attached can be stably and releasably fixed to the knife handle or grip, by a fixing means having a simple construction which can be produced easily at a low cost, thereby to overcome the above described problems of the prior art.

To this end, according to the invention, there is provided a knife apparatus including a knife handle or grip having a substantially C-shaped cross-section defining a groove or a channel extending longitudinally of the knife handle, the groove or channel having penthouse-like web portions extending toward each other from top ends of both side walls of the knife handle defining therebetween a gap through which the groove or the channel is communicated with the outside of the knife handle, one of the web portions being provided with a series of notches formed in its inner edge confronting the other web portion; a cutting blade provided with a number of lines of breakage spaced in the longitudinal direction thereof; and a slider to which the cutting blade is detachably secured, the slider being received by the groove or channel for sliding movement along the length of the groove or channel; characterized by comprising a depressable resilient tab unitary with the slider and extending from the end of the slider opposite to that end which is connected to the cutting blade, the depressable resilient tab being provided with a pawl engageable with the selected one of the notches formed in one of the penthouse-like web portions when the depressable resilient tab is not depressed, the pawl being adapted to be disengaged from the selected notch when the depressable resilient tab is resiliently depressed, so as to allow the slider to be slid along the length of the groove or the channel.

The slider may be provided with a resilient clicking tab extending therefrom in the same direction as the depressable resilient tab so as to extend in parallel with the latter and adapted to be resiliently bent laterally or horizontally, i.e. in the direction transverse to the depressing direction of the depressable resilient tab. The resilient clicking tab has a curved end portion which is concaved at its side confronting the pawl of the depressable resilient tab and is convexed at its other side, such that, when the depressable resilient tab is not depressed, the pawl of the depressable resilient tab is received by the notch in the penthouse-like web portion through the medium of the curved end portion of the resilient clicking tab, i.e. in such a manner that the pawl is received by the concaved part of the resilient retaining tab which in turn is received at its convexed side by the notch.

The depressable resilient tab may be provided with a projection extending laterally therefrom in the direction opposite to the pawl. The projection is adapted to be pressed against the back or lower surface of the other penthouse-like web portion opposing to the web portion having the notches, so as to prevent the depressable resilient tab from springing up due to its resiliency.

The above and other objects, as well as advantageous features of the invention will become clear from the following description of a preferred embodiment taken in conjunction with the accompanying drawings.

DESCRIPTION OF THE PREFERRED EMBODIMENTS

Figure 3:
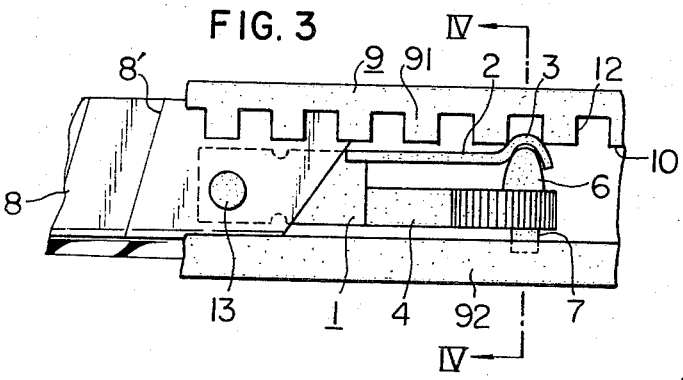
FIG. 3 is a top plan view of the knife apparatus of the invention, showing particularly the mutual engagement of a depressable resilient tab and a notch formed in a knife handle or grip, with a resilient clicking member interposed therebetween.
Figure 4:
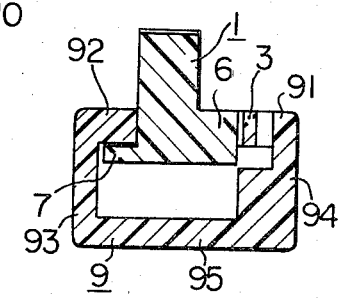
FIG. 4 is a sectional view taken along the line IV—IV of FIG. 3, showing the state of engagement of the depressable resilient tab and the notch with the resilient clicking tab interposed therebetween.

Referring first to FIG. 3, a knife apparatus of the invention has a knife handle or grip generally designated by a reference numeral 9. As will be clearly seen from FIG. 4, the knife handle or grip 9 has a substantially C-shaped cross-section constituted by a bottom wall 95, both side walls 93, 94 and both penthouse-like web portions 91, 92 which in combination define a groove or channel 10 which extends in the longitudinal direction of the knife handle or grip 9. One of the penthouse-like web portions, here the portion 91, is formed with a series of notches 12 in its inner edge confronting the other web portion 92.

The knife apparatus of the invention further has a slider generally designated at a numeral 1. The slider 1 is provided at its front end portion with a boss 13 which is adapted to be received by a through hole of a cutter blade 8 which also constitutes a part of the knife apparatus. The arrangement is such that, as will be seen from FIG. 3, the cutting blade 8 anchored on the slider 1 is moved back and forth relatively to the knife handle or grip 9, so as to be retracted into and projected out of the latter as the slid is slided along the channel 10. The cutting blade 8 is formed with a plurality of oblique lines of breakage 8' disposed at substantially a constant pitch in the longitudinal direction thereof. As is well known, the cutting blade is made fragile particularly along these lines of breakage, so that the cutting blade may be easily broken along the desired line of breakage, thereby to sever the worn out end portion.

Figure 1:
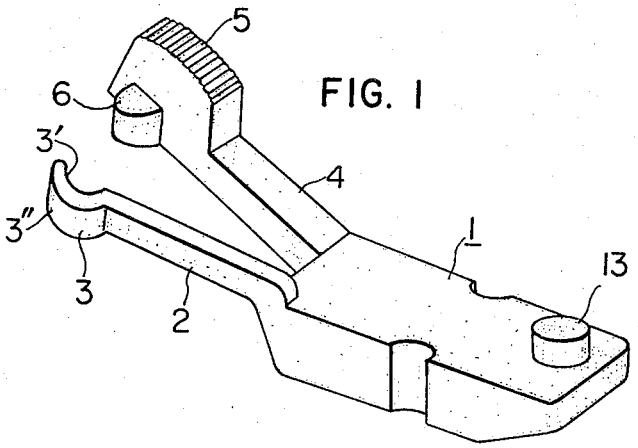
FIG. 1 is a perspective view of a slider which constitutes a part of the knife apparatus embodying the invention, as viewed from one side thereof.
Figure 2:
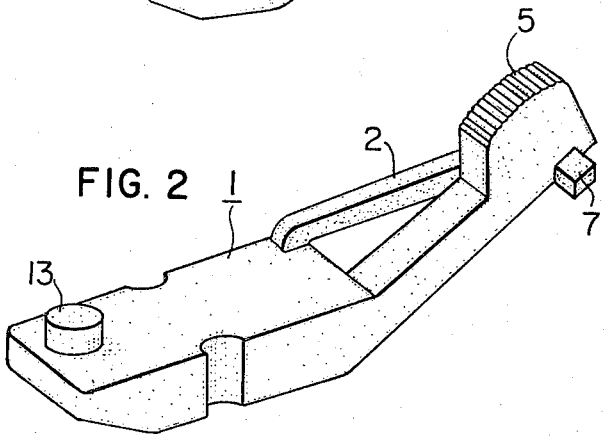
FIG. 2 is another perspective view of the slider as shown in FIG. 1 but viewed from the other side thereof.

The slider 1 is made of a resilient plastic or the like material, and is provided, as shown in FIGS. 1 and 2, with a depressable resilient tab 4 extending rearwardly therefrom, i.e. in the opposite direction to the cutting blade 8. As shown in FIGS. 1 and 2, the depressable resilient tab 4 is somewhat inclined upwardly with respect to the plane of the body of the slider 1. however, the depressable resilient tab 4 can be depressed in such a direction as to reduce the angle of its inclination to the plane of the body of the slider 1, thanks to the resiliency of the latter. The outer or upper end of the depressable resilient tab 4 is shaped to have a roughened top surface 5 for retaining the finger by which the tab 4 is depressed, a pawl 6 extending laterally from one side thereof and a small projection 7 extending from the opposite side. Also, a clicking tab 2 is formed integral with the body of the slider 1 and extends therefrom rearwardly, i.e. in the same direction as the depressable resilient tab 4. As viewed in plan in FIG. 3, the resilient clicking tab 2 has a curved end portion 3, one side 3' of which is concaved to receive the pawl 6 of the depressable resilient tab 4 while the other side 3'' thereof is convexed so as to be received by a selected one of the notches 12 formed in the penthouse-like web portion 91 of the knife handle 9. The resilient clicking tab 2 is so thin-walled that it may be easily bent resiliently laterally or horizontally, i.e. transversely to the direction of depression of the depressable resilient tab 4.

In the assembled state of the knife apparatus of the invention, the slider 1 to which the cutting blade 8 is secured is received by the groove or channel 10 of the knife handle or grip 9, with its projection 7 underlying the penthouse-like web portion 92 in which no notch 12 is formed. Since the depressable resilient tab 4 tends to spring up due to its resiliency, when it is not forcibly depressed, the projection 7 is pressed at its upper surface against the lower surface of the penthouse-like web portion 92, thereby to prevent the further springing up of the depressable resilient tab 4.

In this state, as shown in FIG. 3, the pawl 6 of the depressable resilient tab 4 occupies the same plane or level as the notches 12 formed in the penthouse-like web portion 91, and hence the same plane or level as the resilient clicking tab 2. Thus, in this state, the pawl 6 of the depressable resilient tab 4 is received by the notch 12, through a medium of the resilient clicking tab 2, so as to fix the depressable resilient tab 4 and, accordingly, the slider 1 against the movement along the length of the groove or channel 10.

For extending and retracting the cutting blade 8 out of and into the knife handle or grip 9, it is therefore necessary to disengage the pawl 6 from the notch 12. This disengagement is achieved simply by a depression of the depressable resilient tab 4 downwardly toward the bottom wall 95 of the knife handle or grip 9, against the resilient force exerted by the tab 4 which is made of a resilient material. As the depressable resilient tab 4 is depressed, the pawl 6 is moved downward to disengage from the notches 12 of te penthouse-like web portion 91. In this state, nothing prevents the slider 1 from moving along the length of the groove or channel 10. After the adjustment of the projecting length of the cutting blade, the slider 1 is again latched by the engagement of the pawl 6 with another notch 12, as the depressable resilient tab 4 is released from the manual depression force acting on the roughened surface 5 thereof, so that the slider 1 and hence the cutting blade 8 are strongly fixed against any external force which would otherwise cause a movement of the cutting blade.

It will be understood that, during the sliding of the slider 1 along the length of the groove or channel 10, the resilient clicking tab 2 is allowed to flex freely following the convexities and concavities of the edge of penthouse-like web portion 91 in which the notches 12 are fromed, because in this state it is freed from the pawl 6 of the depressable resilient tab 4 which has been depressed to disengage from the notches 12. During the sliding movement, the resilient clicking tab 2 imparts a certain feel of click to the user.

From the foregoing description, it will be understood that the present invention provides a knife apparatus which fulfills the aforementioned object of the invention.

Namely, a stable fixing of the cutting blade during use under a large pressing force is achieved by a simple construction constituted by the slider having the depressable resilient tab which is engageable with the notches formed in the knife handle or grip. It is advantageous that the slider having the depressable resilient tab 4, resilient clicking tab 2, pawl 6, projection 7 and the boss 13 can be formed of a plastic or the like resilient material, by a single step of injection molding or the like technique, so that the production step of the knife apparatus is much simplified to reduce the production cost.

Having described the invention through its preferred form, it is to be noted that the described embodiment is not exclusive, and various changes and modifications may be imparted thereto.

For instance, the resilient clicking tab which is formed integrally with the body of the slider can be eliminated, if it is not necessary to provide the feel of click. In such case, the pawl is allowed to make a direct contact with the notch.

At the same time, it is not essential to form the depressable resilient tab at an inclination to the plane of the body of the slider. In other words, the depressable resilient tab may be formed to resume the same plane as the body of the slider, when released from the manual depressing force. In such case, the projection formed on one side of the depressable tab may be omitted, because the depressable tab in such case does not spring up.

Further modifications and changes are possible without departing from the spirit and scope of the invention which are limited solely by the appended claims.

What is claimed is:

1. A knife apparatus including a knife handle having a substantially C-shaped cross-section with a bottom wall and opposed side walls defining a groove or a channel extending longitudinally of said knife handle, said groove or channel having penthouse-like web portions extending toward each other from the top ends of said side walls and defining therebetween a gap through which said groove or channel is in communication with the outside of said knife handle, one of said web portions being provided with a series of notches formed in its inner edge confronting the other web portion; a cutting blade formed with a number of lines of breakage spaced in the longitudinal direction of said cutting blade; and a slider having opposite ends to one of which said cutting blade is detachably secured, said slider being received by said groove or channel for sliding movement along the length of said groove or channel;

said slider being characterized by comprising a depressable resilient tab and a resilient clicking tab both secured to the slider and extending generally codirectionally from the end of said slider opposite to said one end thereof, said depressable resilient tab being provided with a pawl, said resilient clicking tab being adapted to be swung in the direction transverse to the direction of depression of said depressable resilient tab and having a curved end portion, said curved end portion of said resilient clicking tab being located opposite said pawl and being concave at one side to enable it to receive said pawl and convex at the other side so as to be engageable with a selected one of said notches formed in said one of said penthouse-like web portions, said depressable resilient tab when not depressed positioning said pawl at the level of said curved end portion of said resilient clicking tab and in engagement with said one side of said curved end portion so that the latter is interposed between said pawl and the selected notch receiving said other side of said curved end portion, said pawl being adapted to be disengaged from said curved portion of said resilient clicking tab when said depressable resilient tab is resiliently depressed, thereby to allow said curved end portion of said resilient clicking tab to disengage from said selected notch and to allow said slider to be slid along the length of said groove or channel.

2. A knife apparatus as claimed in claim 1, wherein said depressable resilient tab and the body of said slider are formed integrally of a plastic.

3. A knife apparatus as claimed in claim 1, wherein said depressable resilient tab, said resilient clicking tab and the body of said slider are formed integrally of a plastic.

4. A knife apparatus as claimed in claim 1, wherein said depressable resilient tab is normally upwardly inclined with respect to the plane of the body of said slider and the plane of said resilient clicking tab and is provided with a projection extending laterally therefrom in the direction away from said pawl, said projection being normally pressed against the lower surface of the other penthouse-like web portion due to the resiliency of said depressable resilient tab so as to prevent said depressable resilient tab from further springing up, thereby to keep said pawl in engagement with said one side of said curved end portion of said resilient clicking tab and to keep said other side of said curved end portion in engagement with said selected notch when said depressable resilient tab is not depressed.

5. A knife apparatus as claimed in claim 1, 2, 3 or 4 wherein said depressable resilient tab is provided with a roughened upper surface for retaining a finger by which said depressable resilient tab is depressed.

* * * * *